US006604634B2

(12) United States Patent
Su

(10) Patent No.: US 6,604,634 B2
(45) Date of Patent: Aug. 12, 2003

(54) RECEIVING BAG WITH ENHANCED AIRTIGHT EFFECT

(76) Inventor: Fu-Long Su, 235 Chung-Ho Box 8-24, Taipei (TW)

( * ) Notice: Subject to any disclaimer, the term of this patent is extended or adjusted under 35 U.S.C. 154(b) by 20 days.

(21) Appl. No.: 09/906,943

(22) Filed: Jul. 18, 2001

(65) Prior Publication Data

US 2003/0015452 A1 Jan. 23, 2003

(51) Int. Cl.[7] ..... B65D 81/20
(52) U.S. Cl. ..... 206/524.8; 206/522; 383/3; 383/103
(58) Field of Search ..... 206/524.8, 522; 383/3, 100, 103, 904; 251/149.6

(56) References Cited

U.S. PATENT DOCUMENTS 4,841,603 A * 6/1989 Ragni ..... 206/522
5,240,112 A * 8/1993 Newburger ..... 206/524.8
5,332,095 A * 7/1994 Wu ..... 137/859
5,450,963 A * 9/1995 Carson ..... 206/522
5,480,030 A 1/1996 Sweeney et al.
5,931,189 A 8/1999 Sweeney et al.
6,059,457 A * 5/2000 Sprehe et al. ..... 206/524.8
6,408,872 B1 * 6/2002 Skeens et al. ..... 137/512.15

* cited by examiner

*Primary Examiner*—J. Mohandesi

(57) ABSTRACT

A vacuum receiving bag is formed by a bag body, a sealing edge installed at an opening of the bag body and an airtight valve at a selected position of the bag body. When the plug cover of the airtight valve is pressed by a hand, the airtight valve will conduct, so that air in the bag body will be absorbed and thus the bag will approach to a vacuum state. On the contrary, after the air absorbing tube is taken away, the airtight valve will close automatically. Next, the airtight valve can be used with an air tap, thereby, an operator may operate a pump manually to achieve the object of absorbing air. Moreover, the seal edge at the opening of the bag body is formed by two matched seal strips, and therefore, a preferred air seal effect is achieved.

5 Claims, 9 Drawing Sheets

RECEIVING BAG WITH ENHANCED AIRTIGHT EFFECT

FIELD OF THE INVENTION

The present invention relates to a receiving bag, and particularly to a receiving bag having an airtight valve.

BACKGROUND OF THE INVENTION

Currently, vacuum packaging is used to package objects for preventing the object from wetness, or being eaten by borers, etc. For packaging in a vacuum state, vacuum receiving bags are developed. The vacuum. receiving bag has an airtight valve and sealing strips. The related prior arts are:

3. U.S. Pat. No. 5,480,030, "Reusable Evacuable Enclosure for Storage of Clothing and the Like"
4. U.S. Pat. No. 5,931,189, "One Way Valve For Use With Vacuum Attachment"

FIG. 3 shows that before absorbing air by vacuuming, the airtight valve of a receiving bag must be opened, and then an envelope must be taken out. Then, an absorbing tube 14 is inserted into an opening of the valve for absorbing air. At this time, an edge of a soft valve piece 26 will curl upwards. Then, air flows out from a hole 24*a*. After air has been absorbed, the edge of the valve piece 26 will restore to the original position to seal the hole 24*a*. Moreover, a hat 32 presses the peripheral edge of the valve 26. Then the airtight cover 20 covers the valve so as to have a preferred sealing effect. However, the prior art airtight valve structure has some defects in operation and storage.

4. When the absorbing tube is removed, the hat 32 and the airtight cover 20 must cover the opening immediately. In this short time period, air will flow into the bag from the hole 27 of a piston rod 26.
5. Although there are several holes 24*a,* the diameters of the holes are small, thus, air absorption rate will be affected.
6. The airtight cover 20 seals the top end of the valve opening 21, but the airtight effect is not good.

Furthermore, the prior art vacuum bag is designed with a sealing edge, the sealing edge is formed by a male sealing strip and a matched female sealing strip. By the engagement of the male and female sealing strips, the opening the bag is sealed. But in this design, only one tenon and one groove are used, the airtight function is not preferred.

SUMMARY OF THE INVENTION

Accordingly, the primary object of the present invention is to provide a vacuum receiving bag formed by a bag body, a sealing edge installed at an opening of the bag body and an airtight valve at a selected position of the bag body. When a user presses the plug cover of the airtight valve through an air absorbing tube, the airtight valve will conduct, so that the air in the bag body will be absorbed. On the contrary, after the air absorbing tube is taken away, the airtight valve can close automatically so that air can not flow into the bag. Next, the airtight valve can be used with an air tap, thereby, an operator may operate a pump manually to achieve the object of absorbing air. Moreover, the seal edge at the opening of the bag body is formed by two matched seal strips. By the sealing edge, a preferred air seal effect is achieved. The sealing edge is formed by two long sealing strips on inner walls of the upper and lower bag surface. One sealing strip is installed with two long convex tracks, and another sealing strip is installed with two long concave tracks. Each of the convex tracks is formed by a left hook, a right hook and a middle trench. The two hooks are opened slightly outwards; each of the concave tracks is formed by a left and a right cambered grooves and a middle tenon. The two convex tracks and two concave tracks are engaged by applying a force thereto. The two hooks of the convex tracks are embedded into said grooves of the concave tracks, thereby, the trench exactly receiving the tenon; thus a preferred airtight sealing effect is achieved.

The various objects and advantages of the present invention will be more readily understood from the following detailed description when read in conjunction with the appended drawing.

DETAILED DESCRIPTION OF THE PREFERRED EMBODIMENTS

Figure 1A:
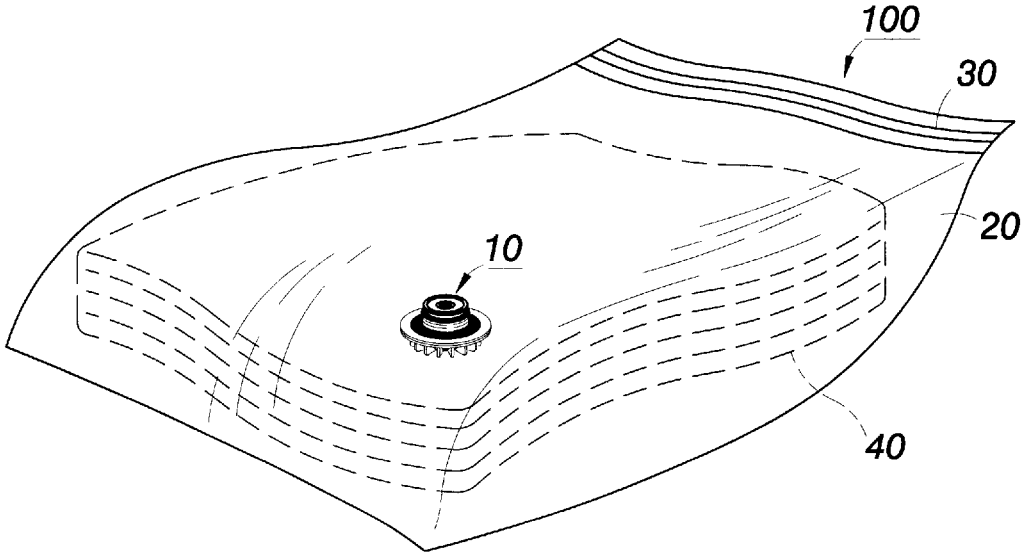
FIG. 1A is a perspective view of the receiving bag of the present invention.
Figure 1B:
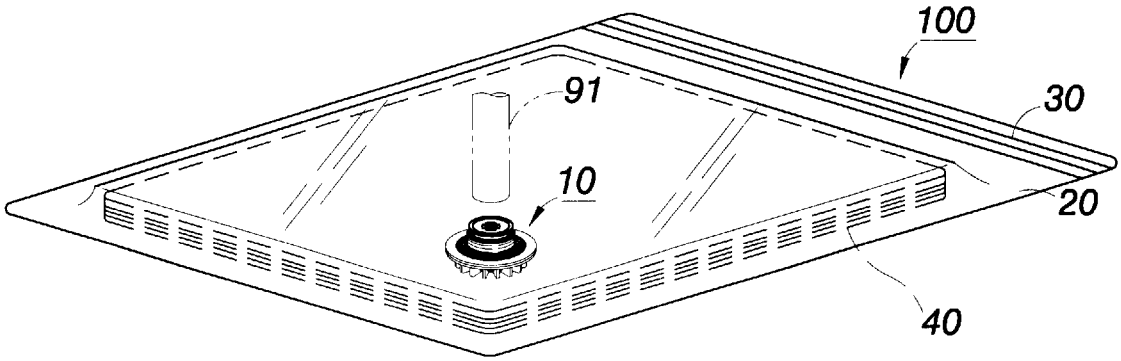
FIG. 1B is a schematic view of the receiving bag of the present invention, wherein air in the receiving bag is drained out and the bag body is sealed.

Referring to FIG. 1A, a perspective view of a receiving bag of the present invention is illustrated. The vacuum receiving bag 100 is formed by a bag body 20, a sealing edge 30 at the opening of the bag body 20, and an airtight valve 10. After an object 40 is placed in the receiving bag 20, then the sealing edge 30 is sealed. Then air in the bag body 20 is released out through the airtight valve 10. Therefore a vacuum receiving. bag is formed, as illustrated in FIG. 1B.

Figure 2A:
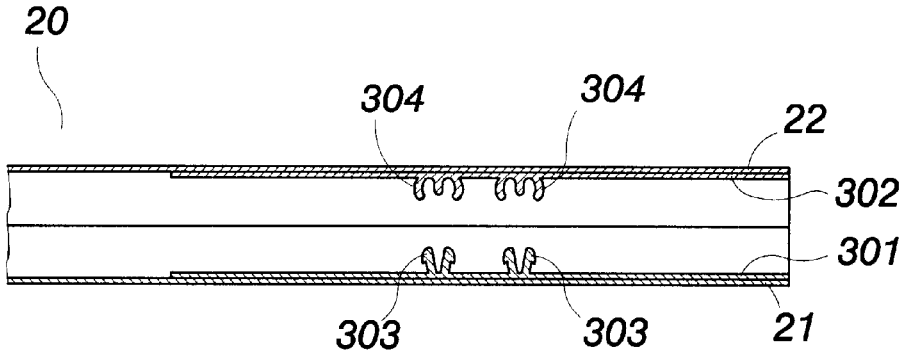
FIG. 2A is a cross section view showing the second edge of the receiving bag of the present invention, where the edge is opened.
Figure 2B:
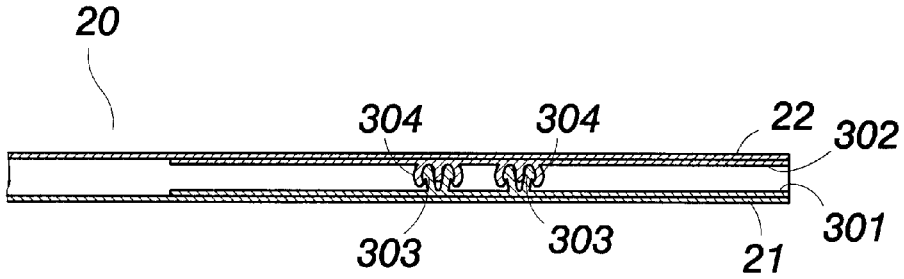
FIG. 2B is a cross section view showing the second edge of the receiving bag of the present invention, where the edge is closed.
Figure 2C:
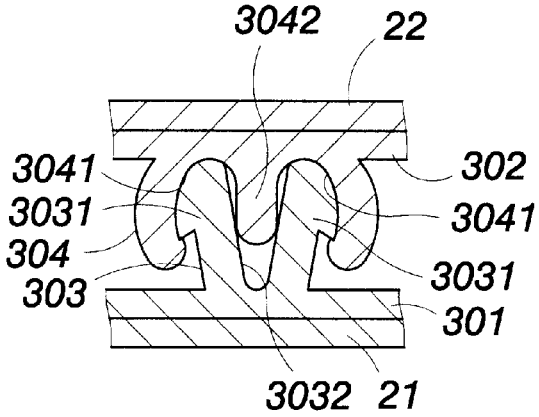
FIG. 2C is an enlarged view showing that the concave tracks and convex tracks of the present invention are engaged to one another.

A cross section view of a receiving bag with an unsealed edge is illustrated in FIG. 2A. A sealing edge 30 is formed at the opening of the bag body 20. The sealing edge 30 is formed by supersonically welding two long sealing strips 301, and 302 to the inner walls of the upper and lower bag surfaces 21 and 22. One sealing strip 301 is installed with two long convex tracks 303. Another sealing strip 302 is installed with two long concave tracks 304. Each convex track 303 is formed by a left and a right hooks 3031 and a middle trench 3032. The two hooks 3031 are opened slightly outwards. Each concave track 304 is formed by a left and a right cambered grooves 3041 and a middle tenon 304. The two convex tracks 303 and two concave tracks 304 are engaged by applying a force thereto, as illustrated in FIG. 2B. The engagement is illustrated in FIG. 2C. When the two hooks 3031 of the convex tracks 303 are embedded into the grooves 3041 of the concave tracks 304, the trench 3032 is exactly received the tenon 3042. After the tenon 3042 is embedded into the trench 3032, the two hooks 3031 will expand outwards, thereby, the hooks 3031 and the groove 3041 being engaged tightly. As a result, airtight sealing effect is achieved. Since the engagement is performed by two convex tracks 303 and two concave tracks 304, the sealing edge 30 of the bag body 20 can airtightly seal the bag by two ways.

Figure 3:
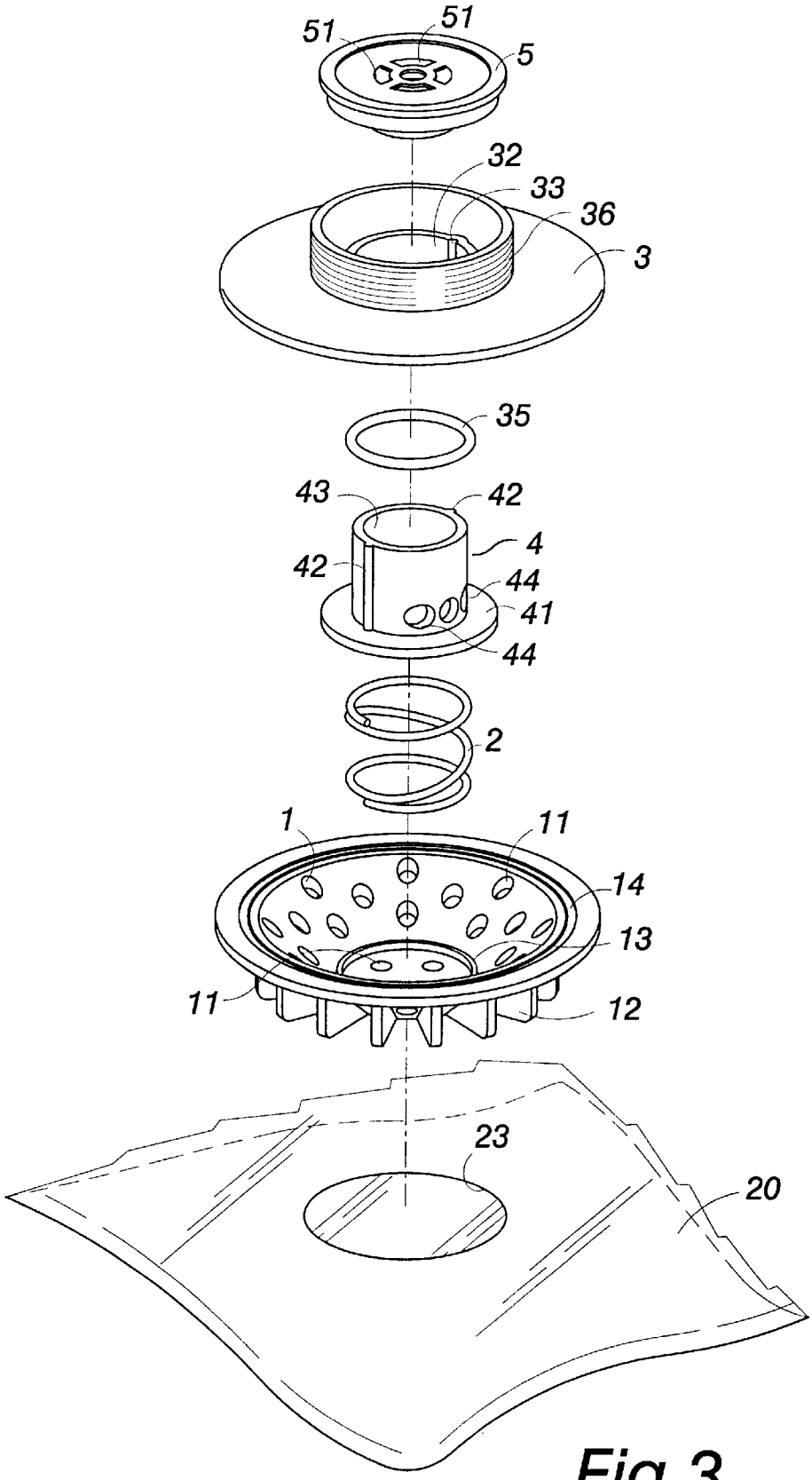
FIG. 3 is an exploded perspective view of the airtight valve of the receiving bag of the present invention.
Figure 4:
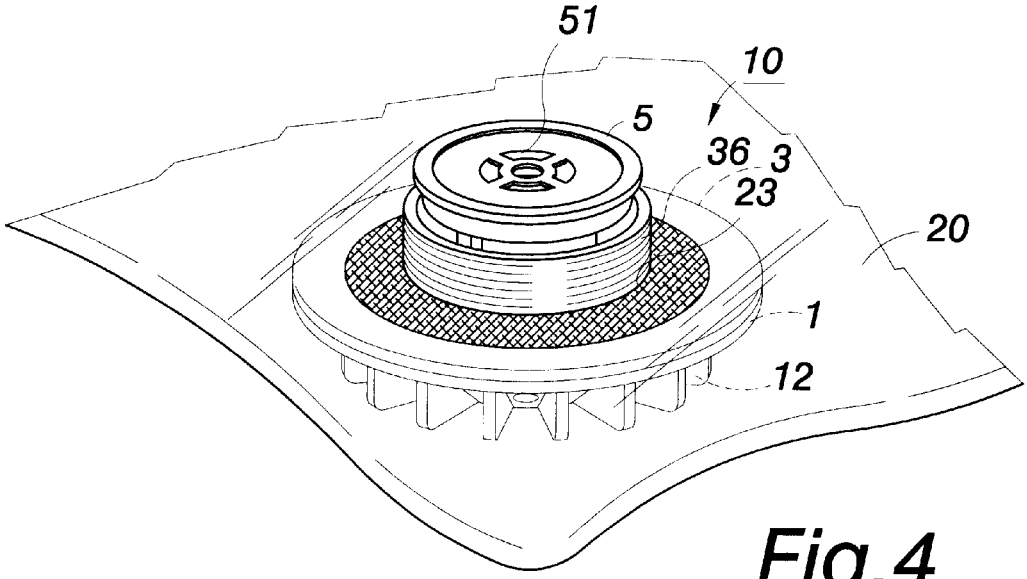
FIG. 4 is an assembled perspective view of the airtight valve of the receiving bag of the present invention.

FIG. 3 is an exploded perspective view of the airtight valve of the present invention. The airtight valve 10 has a lower seat 1, a spring 2 at a center of the lower seat 1 and a top seat 3 sealed to an upper end of the lower seat 1, a plug 4 pivotally installed at a central plug hole of the top seat 3, and a plug cover 5 installed at a top end of the gas stud. The airtight valve 10 assembled is installed at a guide opening 23 of the bag 20, as shown in the FIGS. 4 and 5. Only a threaded seat 36 exposes out of the guide opening 23. The bag surface of the bag body 20 and a top surface of the top seat 3 are thermally welded in high pressure.

Figure 5:
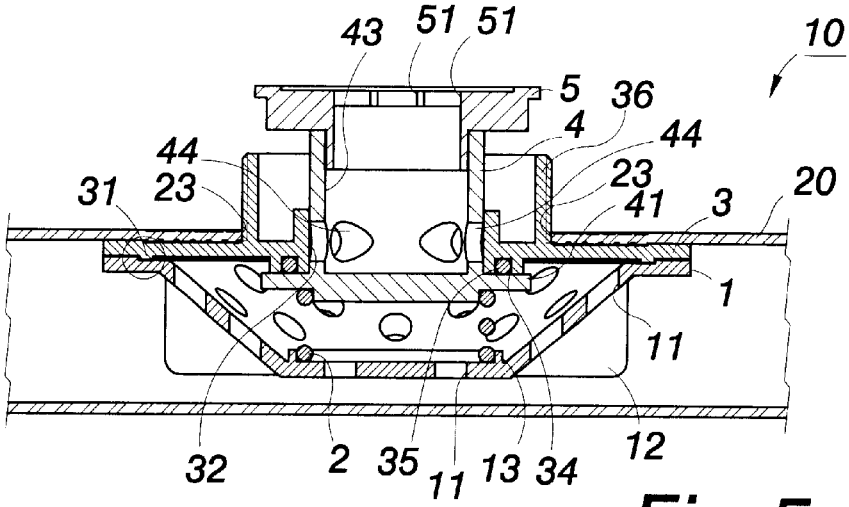
FIG. 5 is a cross section view of the airtight valve of the receiving bag according to the present invention.
Figure 5A:
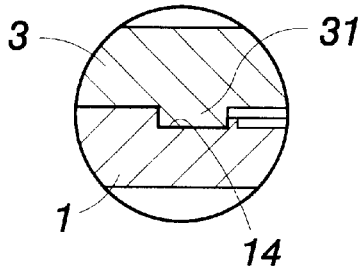

Referring to FIGS. 3 and 5, the seat has a shape like a disk with a plurality of through holes 11 on the surface thereof. The bottom of the lower seat 1 is installed with a plurality of grid plates 12. A bottom of the seat is installed with a ring 13 for positioning the spring 2. An annular groove 14 is formed at the periphery of the seat. The bottom of the top seat 3 has a ring 31 which has a shape matching the annular groove 14. After the ring 31 is engaged to the annular groove 14 (referring to FIG. 5A), they are firmly connected by supersonic connection technology so as to achieve a complete airtight effect.

A thread seat 36 protrudes from the top seat 3. The thread seat 36 has a plug hole 32 for being passed through by the plug 4. The bottom of the plug 4 has a resisting disk 41 which is resisted by the spring 2. The inner wall of the plug hole 32 is formed with an axial trench 33. The axial trench 33 can be engage with the axial protruded strip 42. Thereby, the plug 4 only moves axially in the plug hole 32 without rotation. A bottom of the top seat 3 is installed with an annular groove 34 for receiving a washer 35. When the plug 4 is ejected upwards by the spring 2, an airtight effect is presented.

The plug 4 has an air tank 43 having an opening. The air tank 43 has a lower edge which is formed with a plurality of vents 44. The top of the plug 4 is tightly sealed with the plug cover 5 by supersonic connection technology. The center of the plug cover 5 is formed with a guide hole 51 which is communicated with the air tank 43.

Figure 6A:
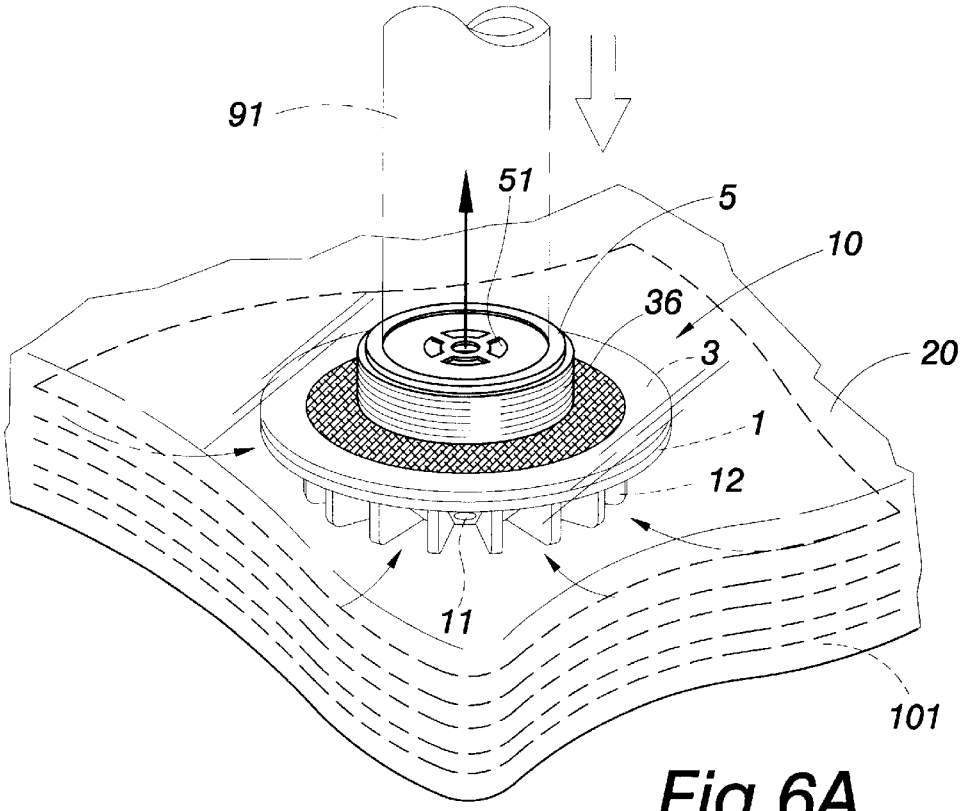
FIG. 6A. is a schematic perspective view showing the airtight valve of the present invention being absorbing air.
Figure 6B:
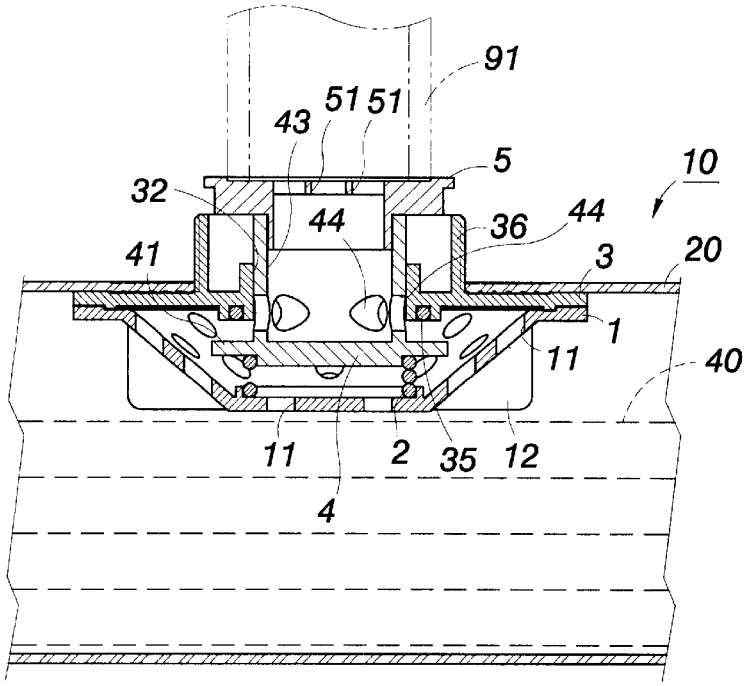
FIG. 6B is a schematic view of FIG. 6A.
Figure 7A:
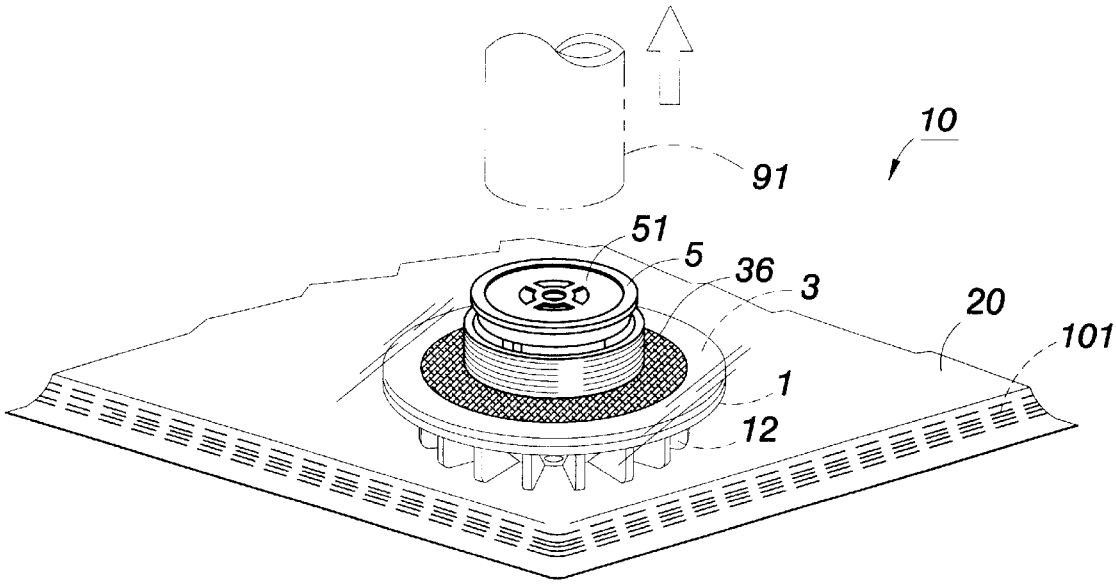
FIG.7A is a schematic perspective view showing the airtight valve is not used according to the present invention.
Figure 7B:
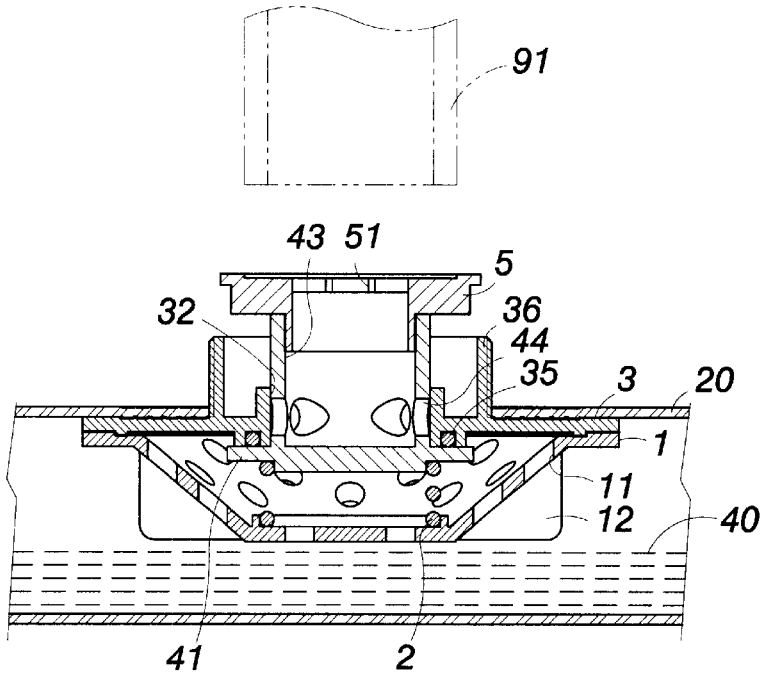
FIG. 7B is a cross section view of FIG. 7A.

With reference to FIGS. 6A and 6B, when the plug cover 5 is pressed by a suction tube 91 of an air compressor device (not shown), the plug cover 5 as well as the plug 4 sunk downwards. An air channel is formed by the bag body 20, through hole 11, air hole 44, and air tank 43, and guide hole 51. When air in the bag body 20 and object 40 are absorbed completely, as shown in the FIGS. 7A and 7B, no extra air in the bag body 20 and object 40, the tube 91 can be removed. The plug cover 5 and plug 4 are pushed by the spring 2 so as to move upwards. Then, the resisting disk 41 and washer 35 are airtightly engaged. Therefore, at the time of removing the tube 91, the air channel will be closed. Outer air can not flow into the channel. The plurality of grid plates 12 below the lower seat 1 may prevent the through hole 11 from being sealed after the bag surfaces are compressed.

Figure 8A:
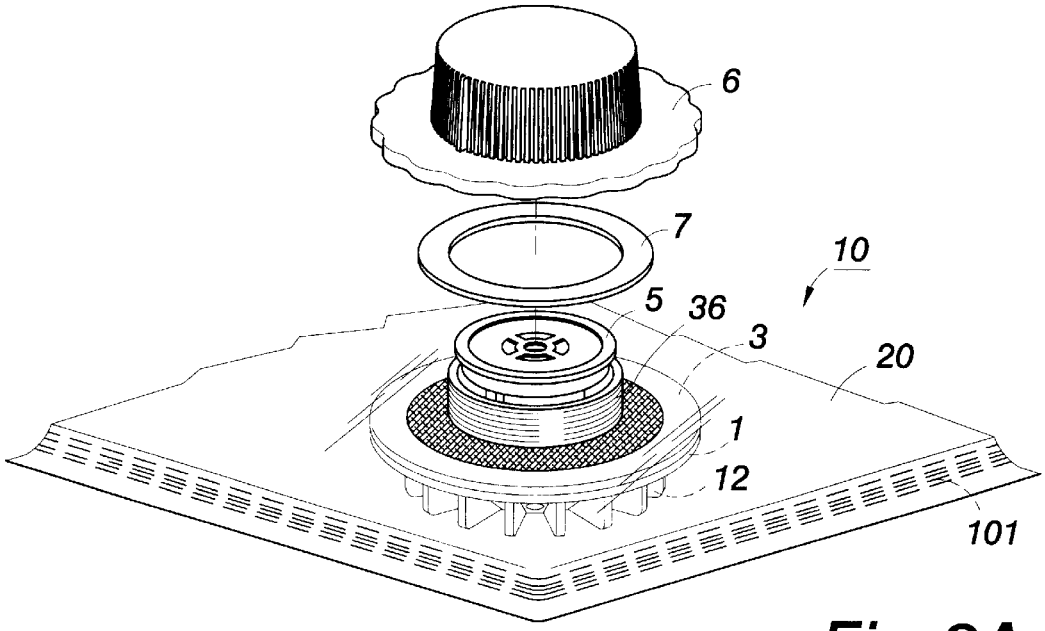
FIG. 8A is a perspective view showing the airtight valve is used with a cover.
Figure 8B:
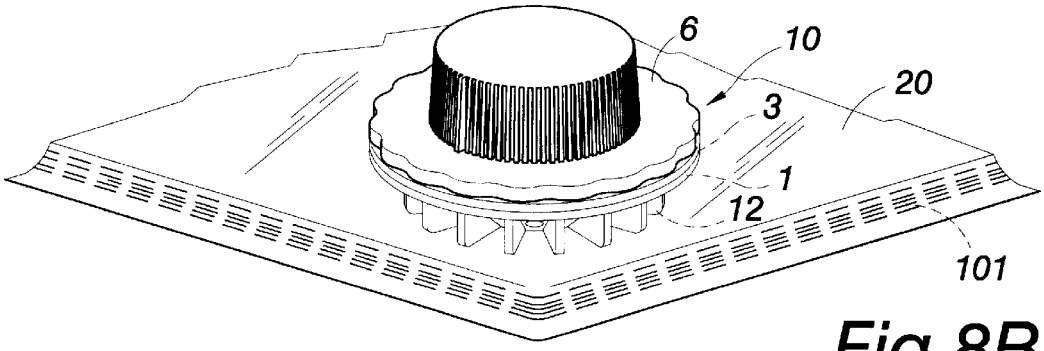
FIG. 8B is an assembled perspective view showing that the airtight valve is matched with a cover.
Figure 8C:
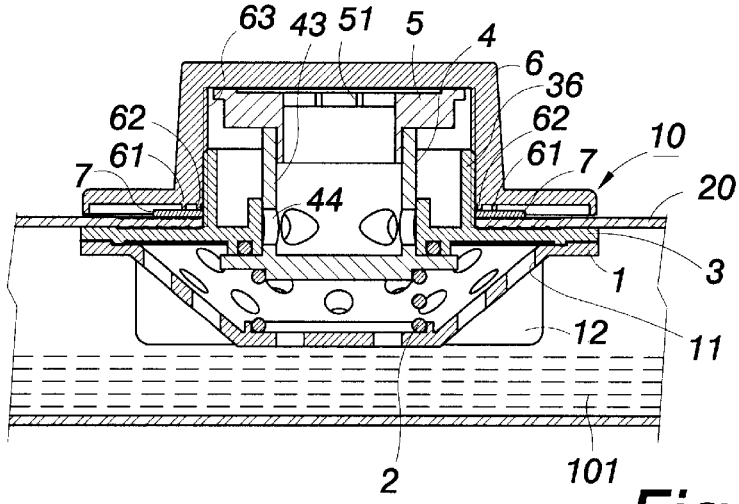
FIG. 8C is a cross section view of the airtight valve in FIG. 8B.

Referring to FIG. 8A, the airtight valve 10 can be screwedly installed to the threaded seat 36 by a threaded cover 6, as illustrated in FIGS. 8B and 8C. The inner wall of the threaded cover 6 has thread 63. After being threaded to the thread seat 36, the bottom of the threaded cover 6 has two annular protruded textures 61 and 62 which press upon a drain-proof washer 7 so as to has a preferred drain-proof ability. By the threaded cover 6 and the drain-proof washer 7, the plug cover is a second drain-proof device, and moreover, the plug cover 5 is prevented from being touched.

Figure 9A:
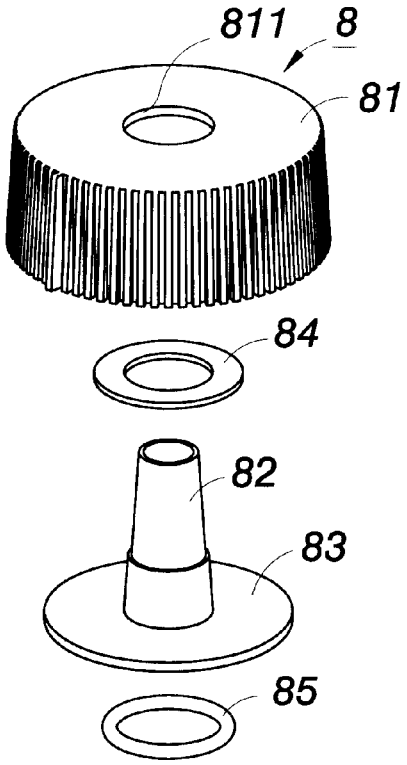
FIG. 9A is an exploded perspective view showing the structure of the air tap according to the present invention.
Figure 9B:
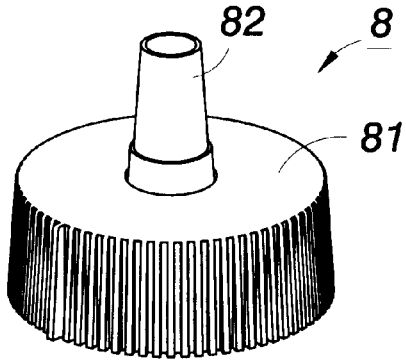
FIG. 9B is an assembled perspective view of the air tap of the present invention.
Figure 9C:
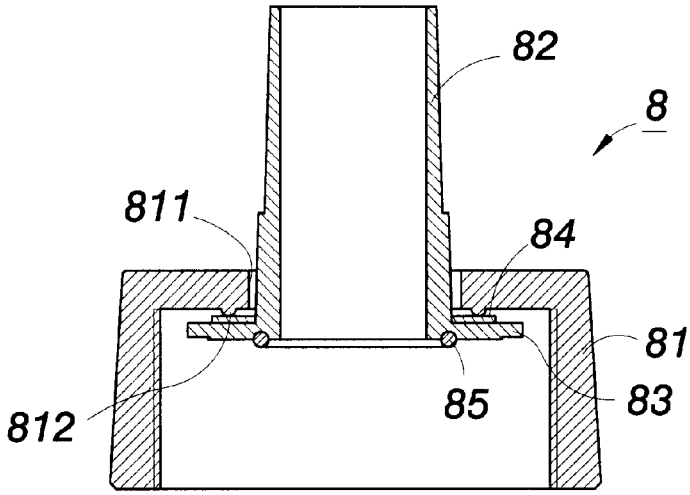
FIG. 9C is a cross section view showing that the air tap and airtight valve are assembled.

Referring to FIG. 9A, an exploded perspective view of the air tap of the present invention is illustrated. The air tap 8 is formed by a plug cover 81 and a guide mouth 82. The assembled view is illustrated in FIGS. 9B and 9C, the plug cover 81 has a central through hole 811 which can be inserted by the guide mouth 82. A lower end of the guide mouth 82 has a stopping disk 83. The upper end of the stopping disk 83 is installed with a washer 84 which is in contact with the protruded ring 812 in the inner wall of the threaded cover 81 so as to generate an airtight effect. A bottom of the stopping disk 83 is installed with a washer 85.

Figure 10A:
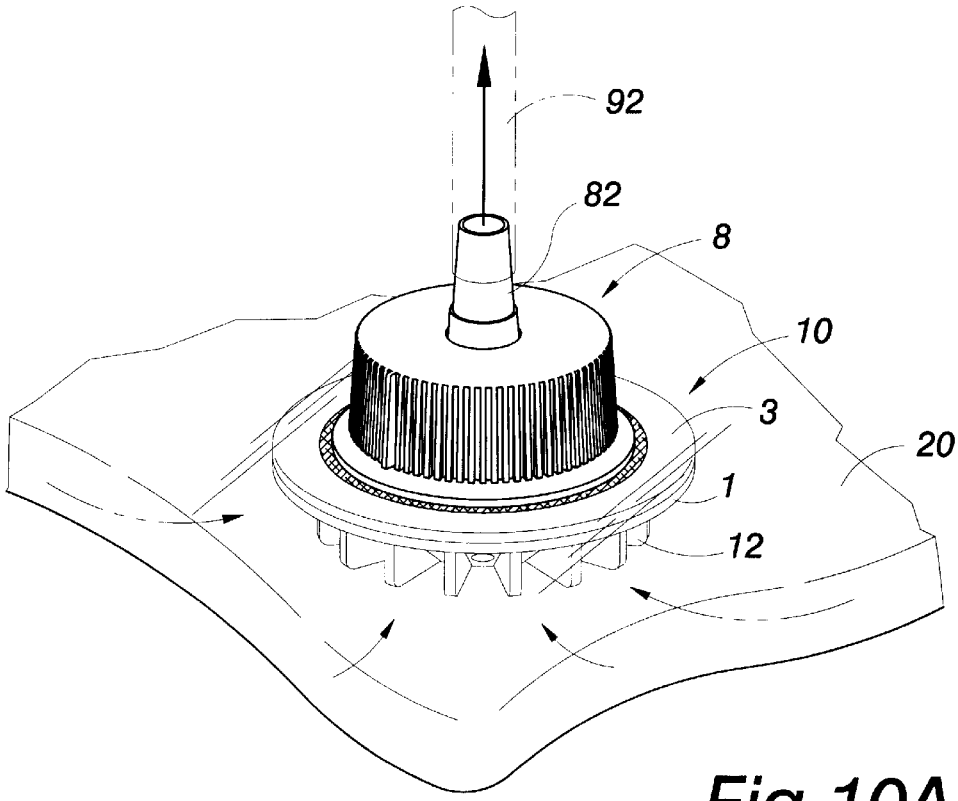
FIG. 10A is a schematic view showing the airtight valve and air tap being used for absorbing air.
Figure 10B:
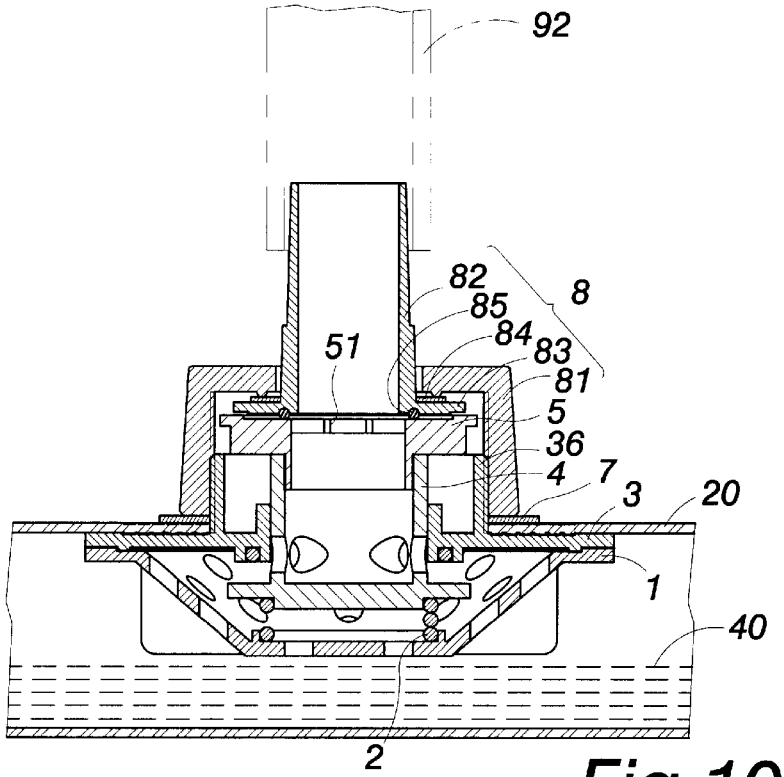
FIG. 10B is a cross section view of FIG. 10A.

Referring to FIGS. 10A and 10B, the threaded cover 81 is threaded to the threaded seat 36 of the airtight valve top seat 3. A washer 86 is disposed between the stopping disk 83 and the plug cover 5. When the air tap 8 as well as the airtight valve 10 are connected, the stopping disk 83 will enforce the plug cover 5 and the plug 4 to descend so that the airtight valve 10 is opened. When the upper end of the guide mouth 82 is connected to the suction tube 92, air is sucked. The suction tube is a general air absorbing tube used in a pump. It is suitable to a manual operation as no air compressor is provided until the bag body 20 is vacuumed. Finally, the threaded cover 81 is detached so that the plug cover 5 and the plug 4 are restored. Thus, the airtight valve 10 restores to a close condition. In this embodiment, the bag body 20 may be used to store water or used outdoors. In this application, clean water fills into the bag from the air tap 8. Then, the water flows through the airtight valve 10 to the bag body 20. After the bag body 20 is filled with water, the air tap 8 can be removed so that the airtight valve 10 is closed. To avoid the user to touch the plug cover 5 by mistake, the threaded cover 6 can be threaded to the threaded seat 36 so as to achieve the object of drain-proof.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A receiving bag having a bag body, a sealing edge disposed along an opening of said bag body, and an airtight valve at a selective position of said bag body, characterized in that said airtight valve is fixed in said bag body, and comprises:

a lower seat having a plurality of through holes arranged in a surface thereof and disposed circularly, and an annular groove being arranged at a top surface of a periphery of said lower seat;

a top seat having a convex ring at a periphery of a bottom thereof, said convex ring being embedded into said annular groove at said lower seat and then being fixed by using supersonic connection technology; a threaded seat protruded from said top seat and protruded out of a guide opening on a surface of said bag body; a plug hole being formed within said top seat; and a bottom of said top seat being formed with a circular groove for receiving a washer; and an air plug inserted into said plug hole of said threaded seat and having a resisting disk at a lower end thereof for resisting against a spring; said air plug being resisted by said spring, thereby, said resisting disk airtightly contacting said washer below said top seat by said resisting disk thereof; said air plug having an air tank with an opening; and a bottom of said air tank being formed with a plurality of air holes;

wherein an airtight valve is formed by above components, thereby, said airtight valve is used to be connected to an air absorbing tube to absorb air within said bag body and has a preferred airtight effect.

2. The receiving bag of claim 1, wherein an inner wall of said plug hole of said top seat is installed with an axial guide trench; and an axial protruding strip is protruded from an outer surface of said air plug, thereby, said air plug axially moving in said plug hole.

3. The receiving bag of claim 1, wherein a bottom of said top seat has a ring for positioning said spring.

4. The receiving bag of claim 1, wherein said threaded seat at said top seat is screwed to a threaded cover.

5. The receiving bag of claim 1, wherein an air tap is installed at said airtight valve; said air tap has a threaded cover screwing to said threaded seat of said top seat, and a guide mouth installed within a central through hole of said threaded cover; a lower end of said guide mouth has a stopping disk integrally connected thereto; an upper side of said stopping disk has a washer which is capable of contacting a ring at said inner wall of said threaded cover so as to present airtight effect; and a bottom of said stopping disk is installed with a washer for contacting said plug cover of said airtight valve to have an airtight effect.

* * * * *